United States Patent [19]

Winstone et al.

[11] Patent Number: 4,915,096

[45] Date of Patent: Apr. 10, 1990

[54] COMBINATION BACK SCRATCHER AND BODY MASSAGER

[76] Inventors: Violet M. Winstone, 1845 Bonita Ave., La Verne, Calif. 91750; Gloria Grassi, 1511 E. Highland Ct., Ontario, Calif. 91764

[21] Appl. No.: 258,664

[22] Filed: Oct. 17, 1988

[51] Int. Cl.[4] ..... A61H 7/00

[52] U.S. Cl. ..... 128/63; 15/222; 128/62 R; 128/DIG. 15

[58] Field of Search ..... 128/62 R, 63, 67, 365, 128/368, DIG. 15; 15/222

[56] References Cited

U.S. PATENT DOCUMENTS

| | | | |
|---|---|---|---|
| 3,213,474 | 10/1965 | Toth | 15/222 |
| 3,812,849 | 5/1974 | Giunta | 15/222 |
| 3,936,198 | 2/1976 | Martin | 401/8 |
| 4,023,567 | 5/1977 | Wessel | 128/63 |
| 4,168,704 | 9/1979 | Wessel | 128/63 |
| 4,187,575 | 2/1980 | Collins | 15/222 |
| 4,422,205 | 12/1983 | Braxter | 15/222 |
| 4,672,707 | 6/1987 | Johnson | 15/222 |
| 4,698,854 | 10/1987 | Stimmon | 15/222 |
| 4,761,849 | 8/1988 | Taylor | 15/222 |

*Primary Examiner*—David A. Wiecking
*Assistant Examiner*—Huong Q. Pham
*Attorney, Agent, or Firm*—Milton S. Gerstein

[57] ABSTRACT

A combination back scratcher/body massager is provided by attaching to one surface of a backing fabric a hook-portion strip of a hook-and-pile fastener, and attaching to the other surface face of the backing fabric the pile-portion strip of the hook-and-pile fastener. The pile-portion strip is usable as a massager, while the hook-portion strip is usable as a scratcher. The product may be used as a head band or robe sash.

10 Claims, 3 Drawing Sheets

COMBINATION BACK SCRATCHER AND BODY MASSAGER

BACKGROUND OF THE INVENTION

The present invention is directed to a combination back scratcher and body massager. There are numerous examples of back scratchers in the prior art. However, none is directed to a combination of back scratcher and body massager incorporating the advantages and uses of the present invention.

SUMMARY OF THE INVENTION

It is the primary objective of the present invention to provide a combination back scratcher and body massager that provides greater effectiveness and comfort.

It is another objective of the present invention to provide such a combination of back scratcher and body massager that allows for easy storage and carrying on the person, so that such is available for use at any desired time and even during strenuous physical activity.

Toward these and other ends, the product of the present invention comprises an elongated piece of fabric defining a pair of opposite surface faces, on one of which is secured along the length thereof a narrower strip of the hook portion of a hook-and-pile fastener, with the other surface face having the mating pile portion strip of the hook-and-pile fastener extending along the length thereof. The ends of the fabric piece may be provided with loops by which one's hands may hold the product for either scratching or massaging various parts of the body. Generally, the pile-portion strip is used for massaging, while the hook-portion strip is used for scratching, although the pile-portion strip also may act as a scratcher to a limited degree. The two oppositely-disposed, mating hook-portion strip and pile-portion strip are also used to attach or secure the product to a desired portion of the body, so that the product may be carried about on the person, and thereby be easily and immediately available when needed. Preferably, such securement may be about the upper portion of the head, as in a head band, which has especial appeal for joggers and bikers, who will then have readily available a massager for the legs during or after exercising. Alternatively, the product may even be secured about the arm as an arm band, or may be made long enough so as to form a belt or sash for a robe, or the like, for home use.

BRIEF DESCRIPTION OF THE DRAWING

The invention will be more readily understood with reference to the accompanying drawing, wherein.

DETAILED DESCRIPTION OF THE INVENTION

Figure 3:
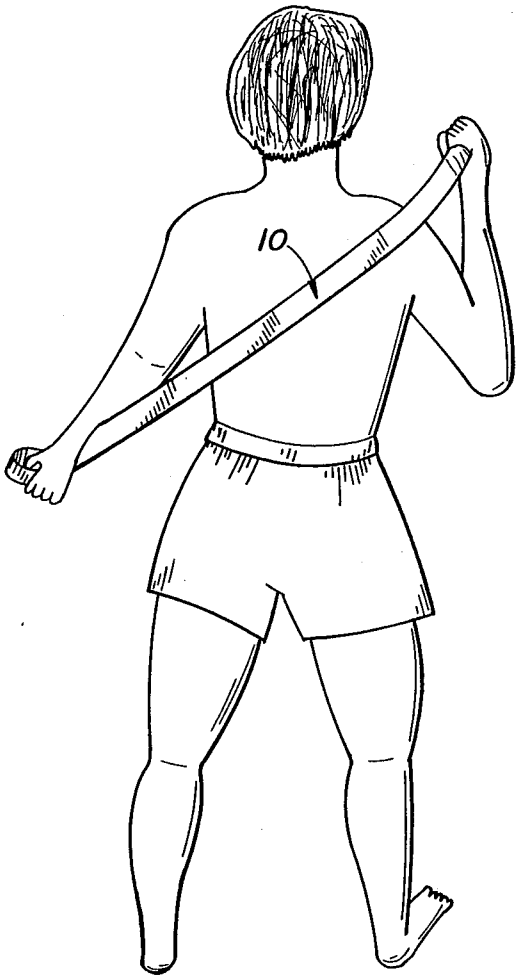
FIG. 3 is an isometric view showing the invention in use.
Figure 1:
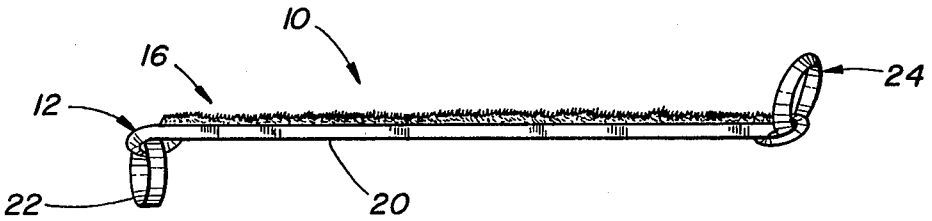
FIG. 1 is a side view of the combined back scratcher and body massager according to the invention showing the two mating strips of a hook-and-pile fastener on the two opposite surface faces of an elongated, main fabric piece.
Figure 2:
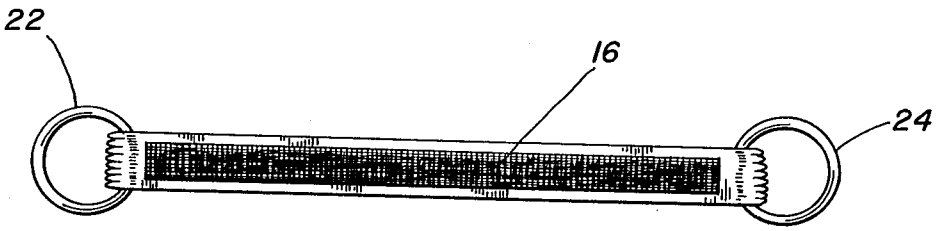
FIG. 2 is a top view thereof.
Figure 4:
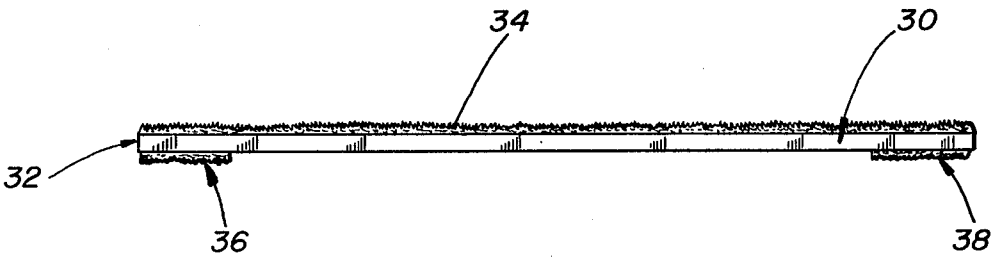
FIG. 4 is a side view of a modification of the combined back scratcher and body massager of the invention.
Figure 6:
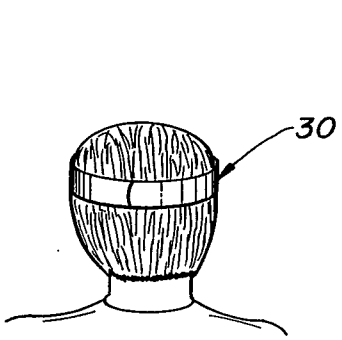
FIG. 6 is a rear view showing the modification in use as a head-band.
Figure 7:
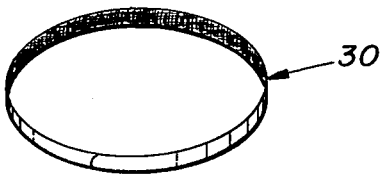
FIG. 7 is an isometric view thereof showing the product of the invention in its closed, secured state.
Figure 5:
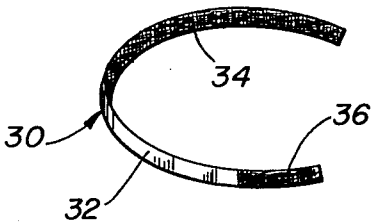
FIG. 5 is an isometric view thereof, showing the product of the invention in its open state.

Referring now to the drawings in greater detail, the combined back scratcher and body massager 10 is shown in FIGS. 1 and 2. The product 10 includes an elongated main piece of fabric 12 constituting the backing or structural member of the product. The piece of fabric 12 may be made of polyester, cloth, and the like, as long as it is provides a durable, strong fabric especially capable of withstanding high tensile forces. Preferably, the fabric is to be water proof and water repellent, though such is not a necessity. The main elongated piece 12 is, also, preferably formed by folding a rectilinearshaped fabric piece along its longitudinal center line, and thereafter stitching the folded-over, juxtapositioned edges together, to thus establish a pair of elongated, longitudinal, oppositely-disposed surface faces. In the embodiment of FIGS. 1 and 2, to one surface face there is sewn or adhesively secured a first strip 16 of the hook portion of a hook-and-pile fastener, sold under the trademark "VELCRO". This hook portion is textured or relatively rough in order to serve as the back scratching surface of the product 10. The strip 16 extends substantially the entire length of the piece 12 along the one surface face thereof, as shown in FIG. 2. The strip 16 is somewhat of lesser width than the width of the elongated piece 12 of fabric, as also clearly shown in FIG. 2 in order that the strip 16 is firmly backed and supported in all directions during hard use thereof when used against the body. The other surface face of the product 10 is provided with a strip 20 constituting the pile portion of the hook-and-pile fastener, while pile portion is relatively smoother, for use for rubbing or massaging muscles of the body, such as the legs. The strip 20 is substantially coextensive with the strip 16, extending substantially the same length and width thereof on the other surface face of the elongated piece 12 of fabric. Each end of the elongated piece 12 of fabric is provided with a loop 22, 24 by which a person may grip the product, in the manner shown in FIG. 3, the product 10 having a length sufficient for scratching the back as shown in FIG. 3. In the preferred form, the width of the piece 12 is between three and four inches, with its length between two and three feet. It may be seen, therefore, that one may use the rougher hook-portion strip 16 for scratching the back or other parts of the body, or may use the pile-portion strip 20 for massaging the muscles of the body, such as the legs. In addition, the product 10 may be secured to a part of the body when not being used or stored elsewhere in a compact state by coupling together the strips 16 and 20 in a manner pertaining to hook-and-pile fasteners. Thus, the product may be entrained and secured about the stomach, thighs and the like, and thus is readily and easily available when needed for massaging or scratching, with the very same fastening strips serving the function as scratcher or massager. It is also desirable to make one loop 22 of smaller radius than the other loop 24, so that the smaller loop 22 may pass through the larger loop 24 during securement of the product 10 about a body part, or other storage place, whereby an excess overhanging length of the product is securable to the juxtapositioned portions thereof via the mating hook-and-pile strips 16, 20 thereof, whereby the end of product does not hang down or dangle in an undesirable manner.

FIGS. 4–7 show a modification of the product specifically adapted for use as a head band, the part of the body to which the product is securable being the head. This modification has especial use for bikers and joggers, providing a readily available massager for the legs, either during or after exercising. The head-band 30 includes an elongated fabric backing piece 32, like fabric piece 12, and an elongated pile-portion strip 34 on the outer surface face thereof, which is used for massaging the leg muscles of the runner or biker. the other, inner surface face of the fabric layer 32 is provided with a pair of short, separated hook-portion strips 36, 38 of a hook-and-pile fastener, one hook-portion 36, 38 at one end portion of the inner surface face. Either of the hookportion strips 36, 38 may be used for mating with a respective, juxtapositioned end portion of the elongated pile-portion strip 34 for securing the head-band about the head, in the manner shown in FIG. 6. In this embodiment, it is preferable, though not necessary, that the fabric piece 32 be made of breathable fabric, such as cotton, and the like, in order to absorb and allow for the evaporation of sweat during exercise. The two hook-portion strips 36, 38 also aid in the holding of the ends of the product 30, one hand grasping one end, by which the head-band may be readily used as a massager for the leg muscles by holding the two ends and reciprocating the product back and forth while the pile-portion strip 34 is pressed against the muscles. Each hook-portion strip 36, 38 may be doubled over twice so as to lie parallel and above a respective end portion of the pile-portion strip 34, and secured to that juxtapositioned portion of the strip 34, so as to thus constitute an end of much greater thickness, made up of three layers, formed by doubling or folding over the end of the product. The thus formed thickened ends of the product provide easy to grasp and hold handle-like portions, keeping their integrity even when released, whereby a better gripping of the product is possible, and a concomitant more effective pressure application of the product against the leg muscles during massaging.

Figure 9:
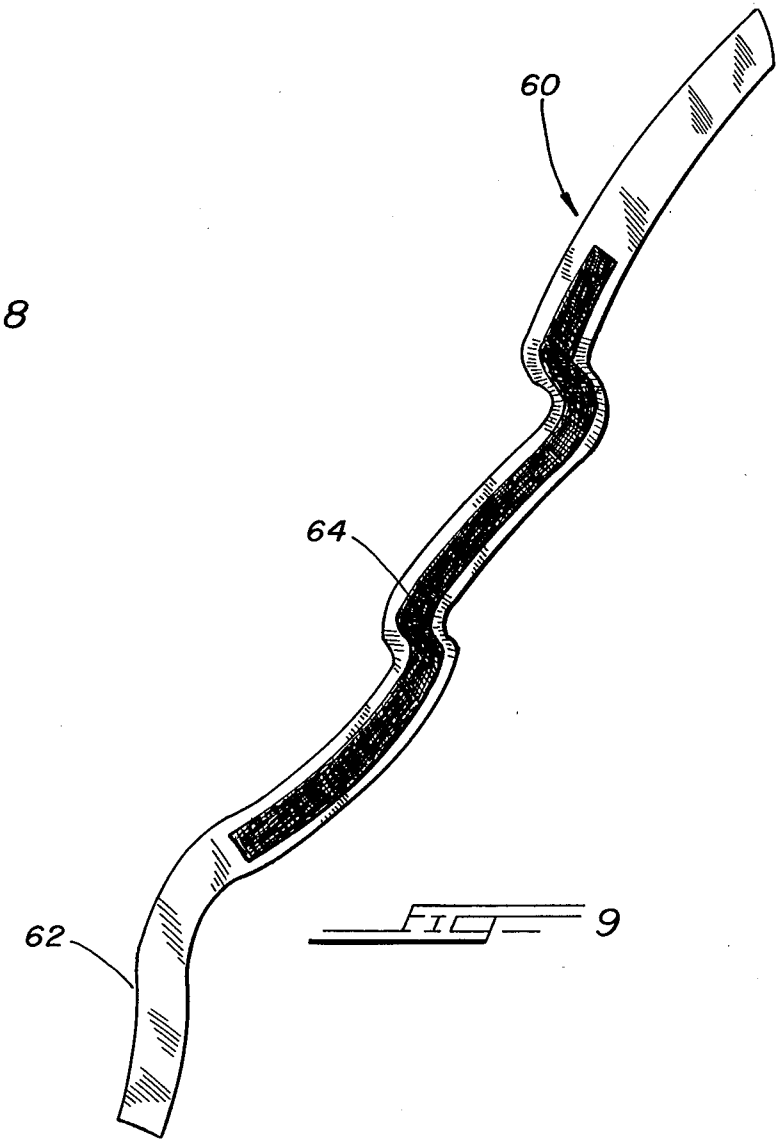
FIG. 9 is a plan view of the modification of FIG. 8 showing one surface face thereof with a strip of one portion of a hook-and-pile fastener.
Figure 8:
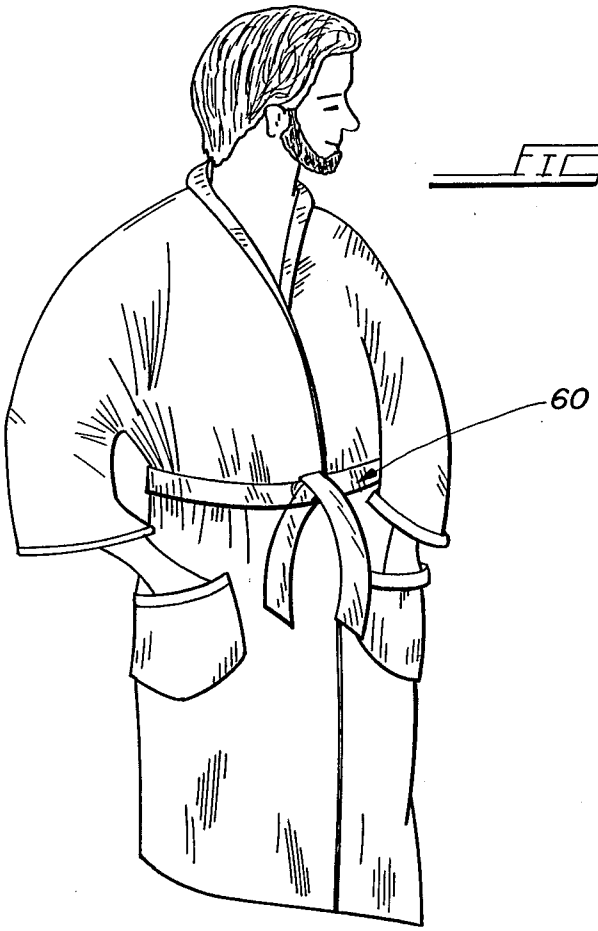
FIG. 8 is an isometric view showing another modification of the product of the invention being used as a sash for a robe.

FIGS. 8 and 9 show still another embodiment of the invention, where the product is used also as a robe belt or sash. In this version, the product 60 is of sufficient length in order to be wrapped about the person, in the manner shown in FIG. 8. The product 60 includes an elongated fabric backing piece 62 to one surface face of which is stitched, or otherwise attached, a hook-portion strip 64 of a hook-and-pile fastener. Although not shown, the other surface face may be provided with a pile-portion strip of the hook-and-pile fastener, as in the embodiment of FIG. 1. The sash 60 may be tied in conventional fashion, as shown in FIG. 8, to accomplish securement about the robe and person, or may be secured via the hook-portion and pile-portion strips. In this embodiment, it is preferred, though not necessary, to make the lengths of the pile-portion and hook-portion strips less the entire length of the product. The product 60 thus serves as a robe sash and a combination back scratcher/body massager. It is preferred that the fabric backing be of waterproof and water-repellent material.

While a specific embodiment of the invention has been shown and described, it is to be understood that numerous changes and modifications may be made therein without departing from the scope, spirit and intent of the invention as set forth in the appended claims.

What we claim is:

1. A product for use as a back scratcher and body massager, comprising:

a main, elongated backing structure having a greater length than width, and defining a front surface face and a rear surface face;

a hook-and-pile fastener comprising aa first elongated hook-portion strip, and a second pile-portion strip;

said hook-portion strip of said hook-and-pile fastener being fixedly secured along the length thereof to said rear surface face along at least a substantial portion of the length thereof;

said pile-portion strip of said hook-and-pile fastener being fixedly secured along the length thereof to said front surface face and extending along at least a substantial portion of the length thereof;

said elongated backing structure defining a first end region and a second end region by which a person's hands may hold said backing structure for massaging and scratching the body by using either said pile-portion strip or said hook-portion strip, respectively, and whereby said backing structure may be secured about a portion of a person's body by interconnecting said hook-portion strip and said pile-portion strip together, the width of each said strips is greater than half of said width of said backing structure.

2. The product according to claim 1, wherein said hook-portion strip comprises a first portion and a second portion, said first portion being fixedly connected at said first end region of said rear surface face, and said second portion being spaced and disconnected from said first portion and fixedly secured to said second end region of said rear surface, whereby said product may be used as a massager and stored as a head band, for use by bikers for massaging their legs.

3. The product according to claim 1, wherein said backing structure is made of a waterproof and water-repellent fabric.

4. The product according to claim 3, wherein each said end of said backing structure comprises a hand-insertable ring by which a person may more easily grasp said backing structure.

5. The product according to claim 4, wherein each said strip has a length and width relatively slightly less than the length and width of said backing structure.

6. The product according to claim 2, wherein said elongated backing structure is made of moisture-absorbing, breathable fabric, whereby perspiration may be absorbed.

7. The product according to claim 6, wherein the length of said backing structure is slightly greater than the circumference of an average person's head, whereby said product serves as a head band.

8. The product according to claim 1, wherein the length of said backing structure is substantially greater than the length of each said strip, said backing structure being a robe sash by which a robe may be secured about the person.

9. The product according to claim 8, wherein said backing structure is made of a waterproof and water-repellent fabric.

10. A method of using a product having an elongated backing structure defining a front surface face and a rear surface face, and comprising a pile-portion strip fixedly secured to said front surface face, and at least one relatively shorter hook-portion strip fixedly secured to said rear surface face, said rear surface face defining a first and a second end region, one said end region mounting said at least one hookportion strip, said method comprising:

(a) securing the backing structure about the upper girth of a person's head so as to serve as a head band;

(b) said step (a) comprising overlapping the ends of the backing structure such that the hook-portion strip is in operative contact with a juxtapositioned portion of the pile-portion strip, and mating the thus-juxtapositioned portions together to releasable secure the head band about the head;

(c) removing the head band about the head; and (d) massaging muscles of the body;

(e) said step (d) comprising rubbing in reciprocal fashion the pile-portion strip against the muscles;

wherein the product comprises two relatively shorter length hook-portion strips mounted at the first and second end regions of the backing structure, one strip at one end region, said method further comprising:

(f) doubling over each end of the backing structure a first time, such that the respective hook-portion strip faces in the same direction as the front surface face;

(b) thereafter, doubling over again the doubled-over ends formed from said step (f), said step (g) also comprising securing the respective hook-portion strip to a respective, juxtapositioned portion of the pile-portion strip, whereby enlarged ends are formed by which the product may be better gripped during said step (d).

* * * * *